United States Patent [19]

Szeluga et al.

[11] 4,085,931

[45] Apr. 25, 1978

[54] DOCUMENT ACTUATED INTERLOCK MECHANISM

[75] Inventors: Ludwick Szeluga, South Windsor; Howard J. Voegelin, Cheshire, both of Conn.

[73] Assignee: Veeder Industries Inc., New York, N.Y.

[21] Appl. No.: 781,589

[22] Filed: Mar. 28, 1977

[51] Int. Cl.[2] ..... B65H 5/00

[52] U.S. Cl. ..... 271/265; 271/3; 271/274; 271/DIG. 9

[58] Field of Search ..... 271/265, DIG. 9, 3, 271/266, 227, 246, 245, 259, 258, 111, 110, 274, 273, 272

[56] References Cited

U.S. PATENT DOCUMENTS

| | | | |
|---|---|---|---|
| 3,178,175 | 4/1965 | Hohmann | 271/266 X |
| 3,261,602 | 7/1966 | Waldenburger | 271/265 |
| 3,666,262 | 5/1972 | Fowler et al. | 271/DIG. 9 X |

*Primary Examiner*—Bruce H. Stoner, Jr.
*Attorney, Agent, or Firm*—Prutzman, Hayes, Kalb & Chilton

[57] ABSTRACT

A document printer with a slot for inserting a document to a printing station of the printer, a switch for conditioning the printer for receiving a document and, upon release, for conditioning the printer for printing the document, a switch operating lever pivotal about each of two mutually perpendicular axes for being pivoted into and out of alignment with the switch and to operate the switch when in alignment therewith, and inner and outer document actuated feelers connected to successively pivot the switch operating lever to operate the switch and then out of alignment with the switch. The inner document actuated feeler is connected to the switch operating lever via an actuating line and is shiftable along the actuating line to shift the position of the document at the printing station.

6 Claims, 4 Drawing Figures

DOCUMENT ACTUATED INTERLOCK MECHANISM

BRIEF SUMMARY OF THE INVENTION

The present invention relates generally to document processing devices operable for reading, printing, etc., documents inserted therein, and more specifically to a document actuated interlock mechanism for interlocking the insertion of the document with the operation of the processing device.

It is a principal object of the present invention to provide a new and improved document actuated interlock mechanism of the type described having a new and improved document actuated sensing device for sensing the partial and complete insertion of a document into the document-processing device.

It is another object of the present invention to provide an interlock mechanism according to the present invention having an economical construction and arrangement of parts.

It is still another object of the present invention to provide an interlock mechanism according to the present invention which is adjustable to accomodate inserting documents different distances into the document processing device.

It is yet another object of the present invention to provide a new and improved interlock mechanism of the type described which utilizes a single control switch for operating a document processing device for receiving a document and for processing the document after it is fully inserted.

It is a further object of the present invention to provide an interlock mechanism according to the invention having first and second document sensors interconnected in a new and improved manner for sensing the initial and complete insertion of a document into a document processing device.

Other objects will be in part obvious and in part pointed out more in detail hereinafter.

A better understanding of the invention will be obtained from the following detailed description and the accompanying drawing of an illustrative application of the invention.

DESCRIPTION OF THE PREFERRED EMBODIMENT

Figures 1, 2, 3, 4:
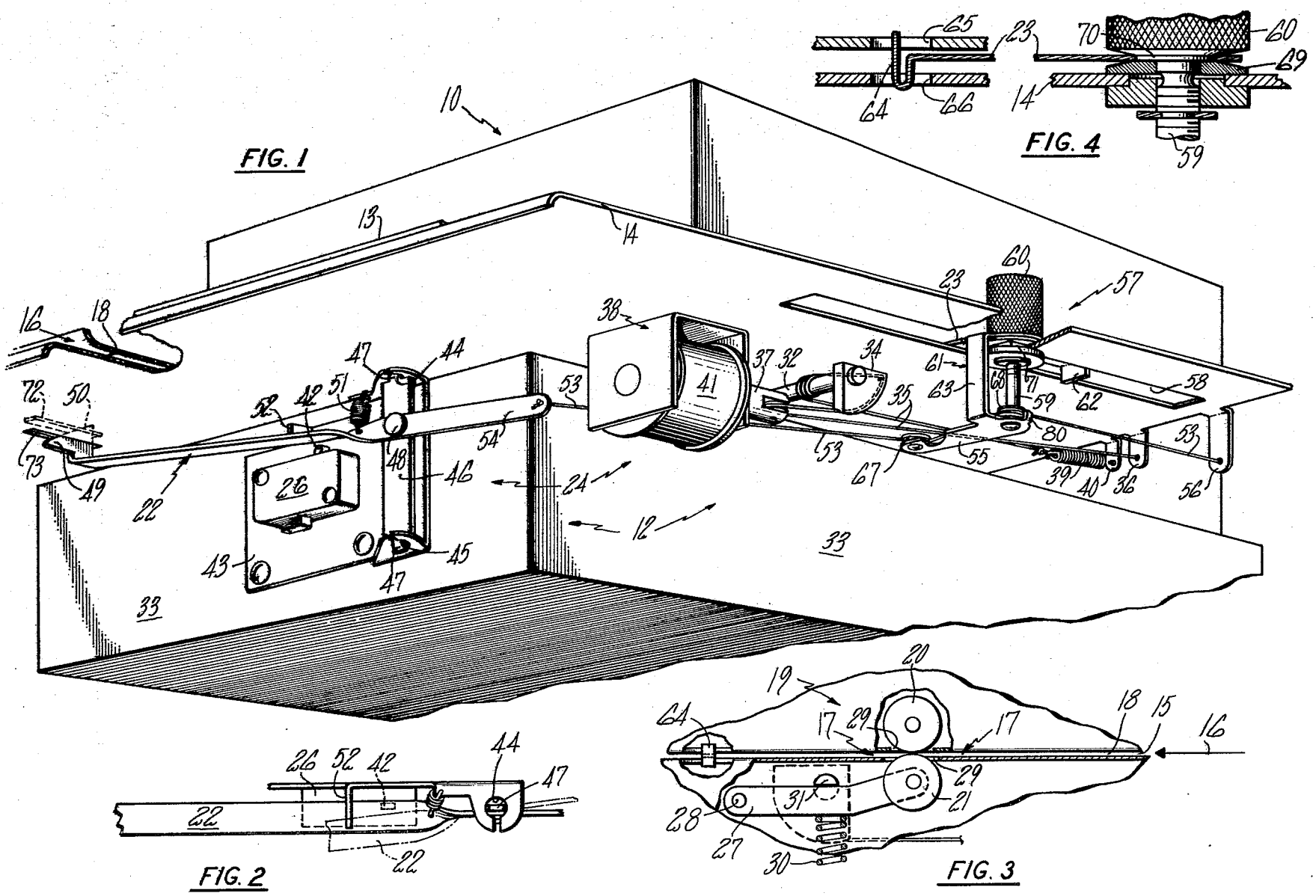
FIG. 1 is an isometric view, partly broken away and partly in section, of a document printer incorporating an embodiment of a document actuated interlock mechanism of the present invention.
FIG. 2 is an enlarged partial top plan view, partly broken away, of a control switch mechanism of the interlock mechanism.
FIG. 3 is a partial side elevation view, partly broken away and partly in section, of the printer of FIG. 1, showing a pair of opposed document feed rolls of the printer.
FIG. 4 is an enlarged partial transverse elevation section view, partly broken away and partly in section, of the printer, showing an inner document sensor mechanism of the interlock mechanism.

Referring now to the drawing in detail wherein like reference numerals indicate like parts throughout the several figures, FIG. 1 depicts a document printer 10 incorporating an embodiment of a document actuated interlock mechanism 12 of the present invention. Excepting for the interlock mechanism 12, the printer 10 may, for example, be a conventional digital printer of the type adapted for receiving and imprinting a document and for ejecting the document following the imprinting operation. It will be appreciated that the invention is also applicable to other types of document processing machines, such as copiers and the like which provide for sequentially inserting a document into the machine, processing the document by reading or duplicating the document, etc. and then ejecting the processed document from the machine.

A pair of generally horizontal upper and lower spaced parallel guide plates 13, 14 of the printer 10 define a channel or slot 15 for inserting a document into the printer 10 in the direction of the arrow 16 and for withdrawing the document from the printer in the opposite direction. The upper and lower guide plates 13 and 14 are respectively flared upwardly and downwardly at the outer end 18 of the slot 15 to facilitate the introduction of a document therebetween. The slot 15 is preferably sufficiently wide to accommodate a range of document widths, its lateral boundary being either open or defined by the housing 33 of the printer 10. It is contemplated that a document may be inserted either mechanically or manually into the slot 15.

In order for the printer 10 to properly imprint an inserted document, it is necessary for the document to be properly longitudinally positioned within the printer for being printed at the printing station 17 of the printer 10. In the shown printer, the document printing station 17 is located so that the document is longitudinally positioned well within the interior of the printer 10 when the document is printed.

A document feed roll mechanism 9 (FIG. 3) is operative to admit a document to be properly positioned at the processing station 17 of the printer 10 preparatory to execution of the printing operation and is also operative to prevent insertion of a subsequent document to the processing station 17 while a previously inserted document is still present. In addition, the document feed roll mechanism 19 is preferably operative for indexing the document outwardly for printing additional lines on the document as desired, and for feeding or ejecting the processed document outwardly from the processing station 17 after the document is fully printed. In the present embodiment, the document feed roll mechanism 19 includes a pair of opposed transversely extending feed rolls 20, 21 mounted to receive a document therebetween and feed the document outwardly. Also, the feed rolls 20, 21 are adapted to be withdrawn apart to permit a document to be inserted, in the direction of the arrow 16, between the rolls 20, 21 to be properly positioned at the document processing station 17.

The separation of the feed rolls 20, 21 is controlled by the document actuated interlock mechanism 12 of the present invention. For that purpose, a first outer document sensing lever or feeler arm 22 is provided for detecting that a document has been inserted into the slot entrance 18, and a second inner document sensing lever or feeler arm 23 is provided for detecting that the document has been fully inserted into the printer 10. The inner document sensing lever 23 is operatively connected with the outer lever 22, whereby both of the levers 22, 23 function to operate a single switch 26 for a feed roll control solenoid 38.

Referring to FIG. 3, the upper or drive feed roll 20 is suitably driven in conjunction with the operation of the printer as desired. The lower or idler feed roll 21 is rotatably mounted on a lever 27 parallel to the drive roll 20, and the lever 27 is pivotally mounted on a pivot pin 28 for pivotal movement parallel to the axes of the feed rolls 20, 21. Thus, by selectively pivoting the lever 27 the backup roll 21 can be selectively pivoted into and out of cooperative association with the feed roll 20. The backup roll 21 is biased into engagement with the feed roll 20 by means of a compression spring 30 acting against the lever 27. The feed roll 21 is retracted downwardly by rotational displacement of a cam 31 provided by a machined flat along one end of a cam shaft 32 which extends laterally outwardly from the housing 33 as seen in FIG. 1.

The cam shaft 32 is rotated in both angular directions by a cable 35; in one angular direction for retracting the feed roll 21, by applying a force with the cable 35 via a pulley segment 34 affixed to the cam shaft 31. For that purpose, the cable 35 extends along a peripheral groove of the pulley segment 34 outwardly around a rotatable sheave mounted on an outer bifurcated end of a linear armature 37 of the solenoid 38 and then inwardly to a depending tab 36 to which the cable 35 is anchored. In the other direction, the cable 35 extends along the peripheral groove of the pulley segment 34, through an aperture in the pulley segment 34 and then around the cam shaft 32 and to a tension spring 39 connected to a depending tab 40.

The tension spring 39 is provided for rotating the cam shaft 32 to its normal position depicted in FIG. 1 and 3 (where the pulley segment 34 engages the underside of the plate 14) for releasing the backup feed roll 21 for engagement with an inserted document or the drive feed roll 21. The solenoid 38 when energized rotates the cam shaft 32, counter-clockwise as seen in FIG. 3, to retract the backup roll 21 from the feed roll 20. The pulley segment 34 and cable 35 therefore combine to translate the linear displacement of the solenoid armature 37 into appropriate angular displacement of the cam shaft 32.

When the solenoid 38 is de-energized, the springs 39, 30 are operative respectively to rotate the cam shaft 32 and pivot the backup roll 21 upwardly into engagement with a document or the feed roll 20. The solenoid 38 is controlled by a switch 26 via a suitable electrical circuit (not shown). The switch 26 is preferably biased to its normally open state and includes a contact actuating member 42 adapted to be depressed to close the switch and thereby withdraw the backup roll 21 with the solenoid 38.

The switch 26 is mounted on a bracket 43 secured to a front face of the housing 33 generally below the slot entrance 18. The guide plates 13, 14 extend longitudinally outwardly from the housing 33 of the printer 10 to create an overhang of several inches. The switch member 42 is actually located directly below the lower guide plate 14.

The switch mounting bracket 43 has upper and lower, vertically opposed, support openings 44 and 45 respectively. A vertical flat pivot bar 46 has a pair of end extension tabs 47 received within the opposed support openings 44, 45 for mounting the flat bar for pivotal movement about a vertical axis. The lever arm 22 is pivotally mounted on the pivot bar 46 by a pivot pin 48 such that the pivotal axes of the lever arm 22 and the pivot bar 46 are mutually perpendicular. Accoringly, the lever arm 22 can be pivoted horizontally into and out of alignment with the switch actuator 42 as shown in full and broken lines respectively in FIG. 2, and when in alignment with the switch actuator 42 can be pivoted up and down to release and depress the switch actuator 42.

The lever 22 has an upstanding document sensing tab 49 received within a pair of opposed slots 72, 73 in the upper and lower guide plates 13, 14 respectively. The generally flat lever arm 22 has a 90° twist at a point between the pivot pin 48 and the switch actuator 42 to provide a flat lever arm section for engaging the switch actuator 42 and to facilitate bending the outer end of the bar upwardly to form the document sensing tab 49. The sensing tab 49 has an inclined leading edge 50 engageable by a document inserted into the slot 15 and is thereby adapted to be deflected downwardly to depress the switch actuator 42 and energize the solenoid 38. A tension spring 51 is connected between the lever arm 22 and the mounting bracket 43 for biasing the lever arm upwardly and inwardly to a withdrawn position in operative alignment with the switch actuator 42 and in engagement with a stop 52 of the mounting bracket 43. The withdrawn horizontal pivotal position of the lever arm 22 bar 46 is established by a cable 53 connected to an outer end 54 of the lever arm 22.

The slots 72, 73 in the guide plates 13, 14 permit the lever arm 22 to be pivotal horizontally into and out of vertical alignment with the switch actuator 42. The horizontal pivotal operation of the lever arm 22 against the bias of the return spring 51 and out of operative alignment with the switch actuator 42 is provided by the connecting cable 53. The cable 53 extends longitudinally from the lever arm 22 partly around each of a pair of idler pulleys 67, 68 mounted on a cable operating arm 55 and then to a depending anchor tab 56 of the lower guide plate 14.

The cable operating arm 55 forms part of a longitudinally adjustable document operated trip assembly 57 having a transverse document sensing lever or feeler arm 23 and a vertical pivot pin or shaft 59. The trip assembly 57 is adapted to be selectively positioned along a longitudinally extending slot 58 extending parallel to the direction of insertion and withdrawal of the document. Accordingly, the trip assembly 57 can be selectively longitudinally positioned to accommodate inserting documents different amounts into the printer 10.

The cable operating arm 55 and the feeler arm 23 are integral portions of a sheet metal member 61 pivotally mounted on the pivot pin 59. The sheet metal member 61 has a connector portion 63 integrally connecting the arms 23 and 55 and a rear arm with a depending tang 62 received within the slot 58 for limiting the freedom of pivotal movement of the arms 23, 55. The feeler arm 23 extends laterally inwardly from the pivot pin 59 between the guide plates 13, 14 and has a generally U-shaped end 64 extending between suitable slots 65, 66 in the guide plates 13, 14 for engagement by the inner end of a document inserted into the printer 10.

The cable control arm 55 extends laterally inwardly from the pivot pin 59 below the lower guide plate 14. The idler guide pulley 68 is mounted on the pivot pin 59 and the outer idler guide pulley 67 is rotatably mounted on the outer end of the cable control arm 55. An upstanding guide tab 80 is provided on the cable control arm 55 adjacent the central guide pulley 68 for assisting in retaining the cable 53 in the groove of the guide pulley 68.

As indicated, the feeler arm 23 and cable control arm 55 are supported for pivotal movement about pivot pin 59. The vertical pivot pin 59 has a large knurled head 60 at its upper end for manually shifting the trip assembly 57 along the longitudinally extending slot 58 and for rotating the pin 59 for selectively locking and unlocking the trip assembly to the plate 14. The pivot pin 59 extends through corresponding hub openings in the feeler arm 23 and cable control arm 55, and an upper clamping washer 69 is mounted on the pivot pin 59 between the plate 14 and an enlarged shoulder 70 of the pivot pin 59. The enlarged shoulder 70 is axially dimensioned to form a suitable bearing for supporting the feeler arm 23 for pivotal movement. A lower threaded clamping nut 71 is threaded onto a threaded section of the pivot pin 59 and has an upper square end received within the slot 58 for keying the clamping nut against rotation. The tab 62 is designed to permit limited but sufficient pivotal movement of the cable control arm 55 to pivot the lever arm 22, for example approximately 10°, out of its normal aligned relationship with the switch actuator 42. The cable 53 is preferably made of nylon and maintained taut by the lever return spring 51 in the withdrawn horizontal pivot position of the switch actuating arm 22.

Referring now briefly to the operation of the document actuated interlock mechanism 21, when a document is inserted into the entrance 18 of the slot 15, it engages and depresses the sensor tab 49 downwardly to depress the switch actuator 42 and thereby energize the solenoid 38, rotate the cam shaft 32 and retract the backup feed roll 21. Accordingly, the document may then be inserted further into the printer 10 between the rolls 20, 21 and into engagement with the feeler or stop 64 to pivot the feeler arm 23 inwardly.

The inward pivotal movement of the sensor arm 23 is operative to pivot the cable control arm 55, and thereby pivot the front sensor arm 22 out of alignment with the switch actuator 42. The actuator 42 is thereby released, the switch 26 is opened and the solenoid 38 is de-energized to release the backup feed roll 21 for engagement with the underside of the document and thereby clamp the document between the rolls 20, 21. The document is then properly positioned and firmly held for being processed by the printer 10 in accordance with the normal operation of the printer. The printing operation is preferably automatically initiated in response to the release of the switch 26 by conventional control means (not shown) forming part of the printer. Also, in a conventional manner, the feed rolls 20, 21 may be used to index the document outwardly for multiple line printing and finally for feeding or ejecting the document outwardly at the end of the processing operation to a position where it may be manually removed.

It can be seen that as long as the feed rolls 20, 21 clamp an inserted document in place, an additional document cannot be inserted into the printer beyond the rolls 20, 21 and to the printing station 17 to interfere with the document printing operation. Also, as long as the inserted document maintains either feeler arm 22 or 23 depressed, a second document will be ineffective in actuating the switch 26 and retracting the backup roll 21.

After an inserted document is removed, the return spring 51 acts to return the lever arm 22, cable 53 and cable control arm 55 to their normal position shown in FIG. 2, and the printer processing cycle is thereupon completed for conditioning the printer for receiving a successive document.

As will be apparent to persons skilled in the art, various modifications, adaptations and variations of the foregoing specific disclosure can be made without departing from the teachings of the present invention.

We claim:

1. In a document processing machine adapted to be successively conditioned, first in preparation for processing a document and subsequently for processing a document and having a document channel for feeding a document along a predetermined path to an initial processing station of the machine and a document actuated interlock mechanism for selectively conditioning the machine in its said first preparatory condition when a document is partly fed along said predetermined path to said initial processing station and in its said subsequent processing condition when the document is fully fed to said initial processing station and having a control switch adapted to be successively actuated to first and second switching positions thereof for successively conditioning the machine in its said preparatory and said subsequent processing conditions respectively; the improvement wherein the document actuated interlock mechanism comprises first and second document feelers along said predetermined path adapted to be actuated by the document when it is partly and fully fed to said initial processing station respectively, and mechanical interconnect means having switch operating means actuated by the first document feeler for operating the control switch to its said first switch position when the first document feeler is actuated by a document and actuated by the second document feeler for operating the control switch to its said second switch position when the second document feeler is actuated by the document.

2. The document processing machine of claim 1 wherein the switch operating means comprises a switch operator mounted for first shiftable movement in opposite directions into and out of operative alignment with the control switch for operation thereof and mounted for second shiftable movement in opposite directions for selectively operating the control switch to its said first switch position when the switch operator is in operative alignment therewith, and wherein the mechanical interconnect means connects the first and second document feelers to the switch operator for respectively shifting the switch operator when actuated by a document for operating the control switch to its said first switch position and out of operative alignment with the control switch respectively.

3. A document processing machine according to claim 2 wherein the first document feeler is mounted on the switch operator for shifting the switch operator for selectively operating the control switch to its said first switch position.

4. A document processing machine according to claim 2 wherein the second document feeler comprises pivotal arm means mounted for being pivotally actuated by a document when it is fed to said initial processing station, and inner and outer radially spaced guides on the arm means; wherein the mechanical interconnect means comprises an actuating line passing around the inner and outer guides and extending in opposite directions therefrom respectively generally parallel to said document feed path, the line section extending from the outer guide being connected to the switch operator to shift it out of operative alignment with the control switch when the arm means is pivotally actuated by a document, the line section extending from the inner guide being relatively fixed; and means for adjusting the pivotal arm means generally parallel to said document path to adjust the position of the document when it actuates the pivotal arm means.

5. A document processing machine according to claim 2 wherein the switch operator is pivotally mounted about a first axis for said first shiftable movement in opposite pivotal directions and is mounted about a second axis generally normal to said first axis for said second shiftable movement in opposite pivotal directions.

6. In a document processing machine adapted to be conditioned for processing a document and having a document channel for feeding a document along a predetermined path to an initial processing station of the machine and a document actuated interlock mechanism for conditioning the machine for processing a document when the document is fed to said initial processing station and having a control switch adapted to be operated for conditioning the machine for processing a document and a shiftable switch operator adapted to be shifted for operating the control switch; the improvement wherein the document actuated interlock mechanism comprises pivotal arm means pivotally mounted for being pivotally actuated by a document when it is fed to said initial processing station, inner and outer radially spaced line guides mounted on the arm means, an actuating line passing around the inner and outer guides and extending in opposite directions therefrom respectively generally parallel to said predetermined path, the line section extending from the outer guide being connected to the switch operator to shift the switch operator, and thereby operate the control switch for conditioning the machine for processing a document, when the arm means is pivotally actuated by a document, the line section extending from the inner guide being relatively fixed, and means for adjusting the pivotal arm means generally parallel to said document path to adjust the position of the document when it actuates the pivotal arm means.

* * * * *